US006681940B1

(12) United States Patent
Cash et al.

(10) Patent No.: US 6,681,940 B1
(45) Date of Patent: Jan. 27, 2004

(54) TOOL RACK ORGANIZER

(76) Inventors: Michael J. Cash, 7273 Turner Fish Rd., Willow Springs, NC (US) 27592; James A. Buffaloe, 7926 Fayetteville Rd., Raleigh, NC (US) 27603

( * ) Notice: Subject to any disclaimer, the term of this patent is extended or adjusted under 35 U.S.C. 154(b) by 0 days.

(21) Appl. No.: 10/326,939

(22) Filed: Dec. 23, 2002

Related U.S. Application Data

(63) Continuation-in-part of application No. 10/000,621, filed on Nov. 1, 2001, now abandoned.

(51) Int. Cl.[7] ..... A47F 7/00
(52) U.S. Cl. ..... 211/70.6
(58) Field of Search ..... 211/70.6, 81, 96, 211/60.1, 63, 65, 66, 87.01

(56) References Cited

U.S. PATENT DOCUMENTS 729,404 A * 5/1903 Perkins ..... 211/104
1,936,813 A * 11/1933 West et al. ..... 211/96
2,192,882 A * 3/1940 De Muth ..... 211/96
2,345,745 A * 4/1944 Goldbert ..... 211/96
2,975,907 A * 3/1961 Hirsch ..... 211/96
2,996,192 A * 8/1961 Dell et al. ..... 211/49.1
4,863,020 A * 9/1989 Klemow ..... 206/702
5,236,095 A * 8/1993 Krizka ..... 211/96
5,526,941 A * 6/1996 Ford ..... 211/59.1
6,206,210 B1 * 3/2001 Reed ..... 211/96

* cited by examiner

*Primary Examiner*—Alvin Chin-Shue
*Assistant Examiner*—Sarah Purol
(74) *Attorney, Agent, or Firm*—Mills Law Firm PLLC

(57) ABSTRACT

A tool rack organizer having a support assembly including rows of horizontal arms normally disposed in parallel spaced relation to a storage wall. The outer arms are pivotally connected to the support assembly for independent movement between a closed position and an open position. The arms are provided with a series of longitudinally spaced opening for attaching implement hooks to thereby hang customary tools, equipment and other implements. The organizer, with the compact rows of hooks, provides a compact rack arrangement for storing and accessing a multiplicity of tools in a minimum of wall space.

16 Claims, 11 Drawing Sheets

TOOL RACK ORGANIZER

RELATED APPLICATION

This application is a continuation-in-part application of U.S. Ser. No. 10/000,621 filed on Nov. 1, 2001 in the name of Cash et al. and entitled "Tool Rack Organizer", now abandoned.

FIELD OF THE INVENTION

The present invention relates to tool storage and, in particular, to a compact tool rack for the storage and organization of tools and equipment.

BACKGROUND OF THE INVENTION

Various tools and equipment are required for the maintenance and landscaping of a household and grounds. Many are elongated and bulky and pose difficulties in storage within a garage or utility enclosure. More often, than not, the items are stored in available corners or niches in commingled order, making organization and retrieval difficult. Unlike small hand tools where a multiplicity of organized enclosures are available, typical household tools and equipment are large and diverse in size and shape. Accordingly, mobile tool cabinets as disclosed in U.S. Pat. No. 5,221,132 to Combs et al. cannot be utilized. Similarly, wall mounted magnetic holders as disclosed in U.S. Pat. No. 4,682,698 to Handler et al. provide inadequate strength for large items such as rakes, shovels and the like.

Tool organizers specifically adapted to these tools and equipment have generally taken a linear format wherein the items are arranged in serial side-by-side relationship. For instance, U.S. Pat. No. 5,143,228 to Arnold discloses a garden equipment support rack wherein a wire frame, mounted on a wall, includes a pair of linearly spaced hooks for supporting the tool. U.S. Pat. No. 5,778,092 to Teeny discloses a wire frame rack having a plurality of linearly spaced pockets for aligning the handles of elongate articles. Similarly, U.S. Pat. No. 2,587,226 to Rodman discloses a random tool rack having spaced hooks for supporting handled tools. Additionally, U.S. Pat. No. 5,411,191 to Bunn discloses a rack for a pickup truck wherein the handles of the tools are supported in a series of aligned cylindrical members. While the foregoing approaches provide for adequate organization and storage, a multiplicity of tools requires considerable lineal space, which is not always available.

Accordingly, it is an object of the present invention to provide an organizing and storing device for compactly holding elongated implements.

Another object is to provide a tool organizer having a plurality of rows of tool supports that may be individually accessed.

A further object is to provide a tool organizer having rows of pivotal arms supporting elongated tools that may be selectively pivoted to store and access the desired implement.

SUMMARY OF THE INVENTION

The foregoing objects are accomplished by a tool rack organizer having a support assembly including rows of horizontal arms normally disposed in parallel spaced relation to a storage wall. The outer arms are pivotally connected to the support assembly for independent movement between a closed position and an open position. The arms are provided with a series of longitudinally spaced opening for attaching implement hooks to thereby hang customary tools, equipment and other implements. The organizer, with the compact rows of hooks, provides a compact rack arrangement for storing and accessing a multiplicity of tools in a minimum of wall space.

DESCRIPTION OF THE DRAWINGS

The above and other objects and advantages of the present invention will become apparent upon reading the following detailed description taken in conjunction with the accompanying drawings in which.

DETAILED DESCRIPTION OF THE PREFERRED EMBODIMENTS

Referring to FIGS. 1 through 5 for illustrating one preferred embodiment, there is shown a tool rack organizer 10 mounted on a vertical support surface 12, such as a garage or storage wall, and supporting and organizing various articles 14 typically housed therein such as lawn and garden implement, tools and the like.

Figure 1:
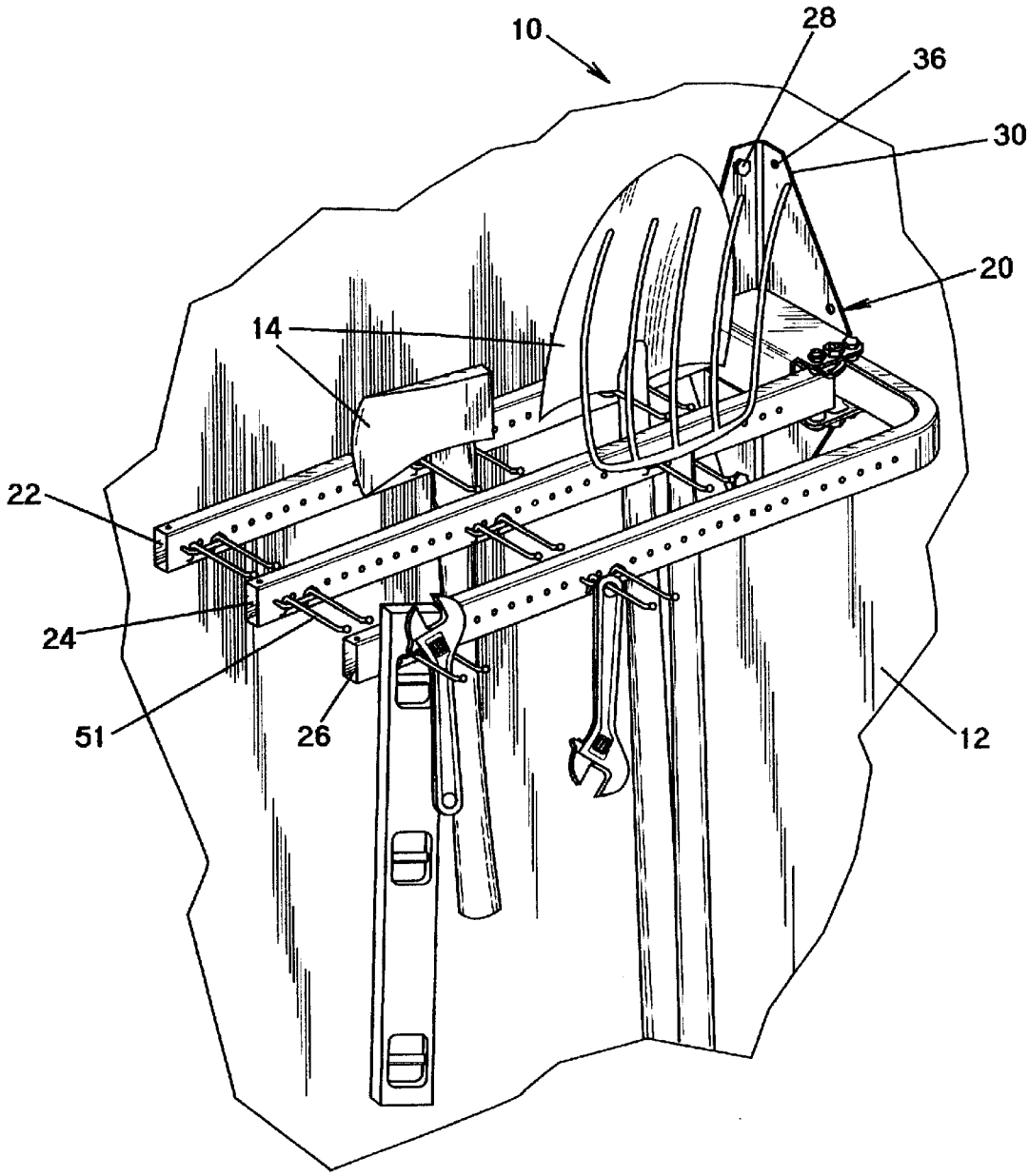
FIG. 1 is a perspective view of a tool rack organizer, in accordance with one embodiment of the invention, attached to a mounting surface and carrying various articles.
Figure 2:
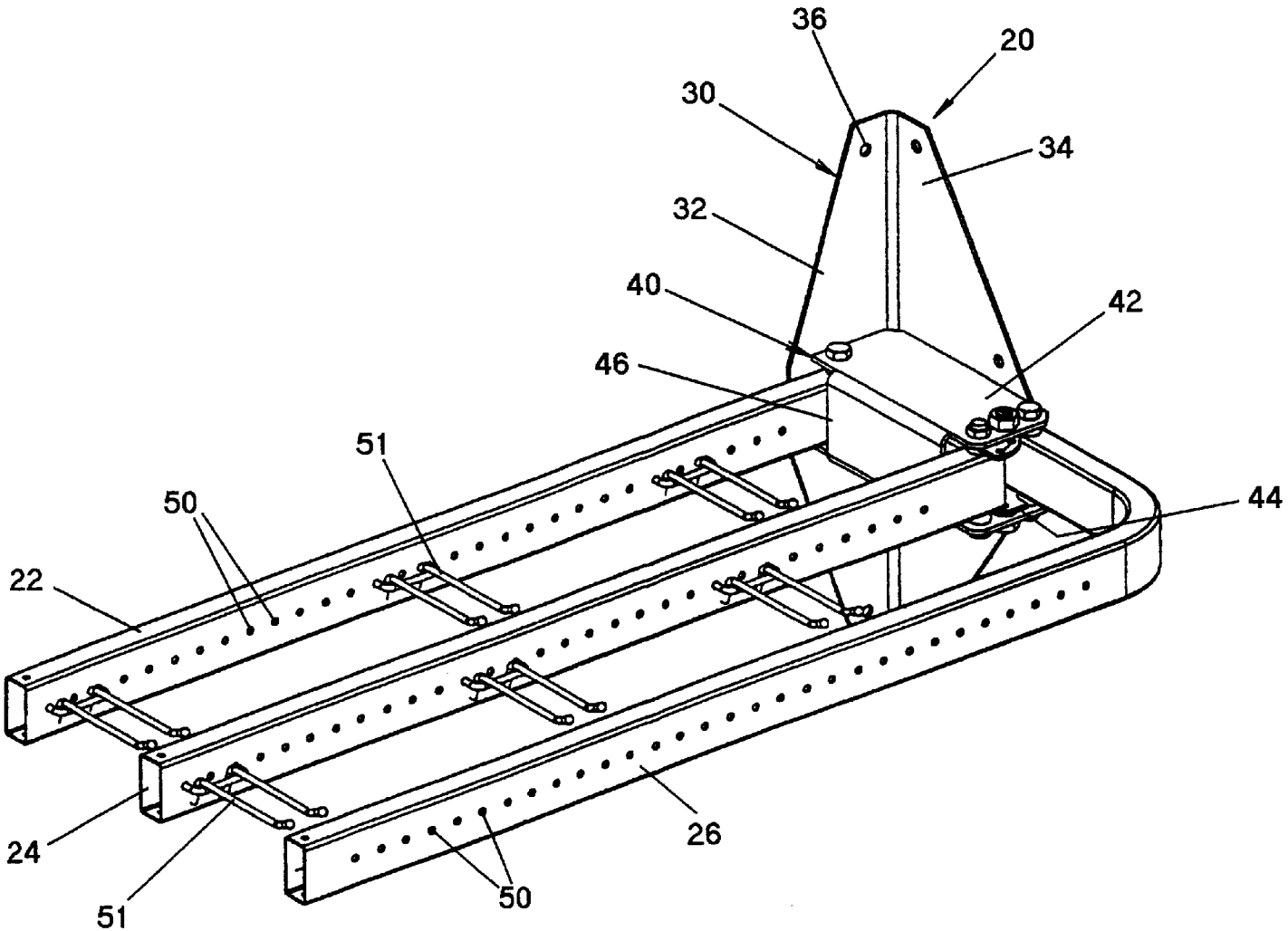
FIG. 2 is a front perspective view of the tool rack organizer of FIG. 1 with the support arms in the closed position.
Figure 3:
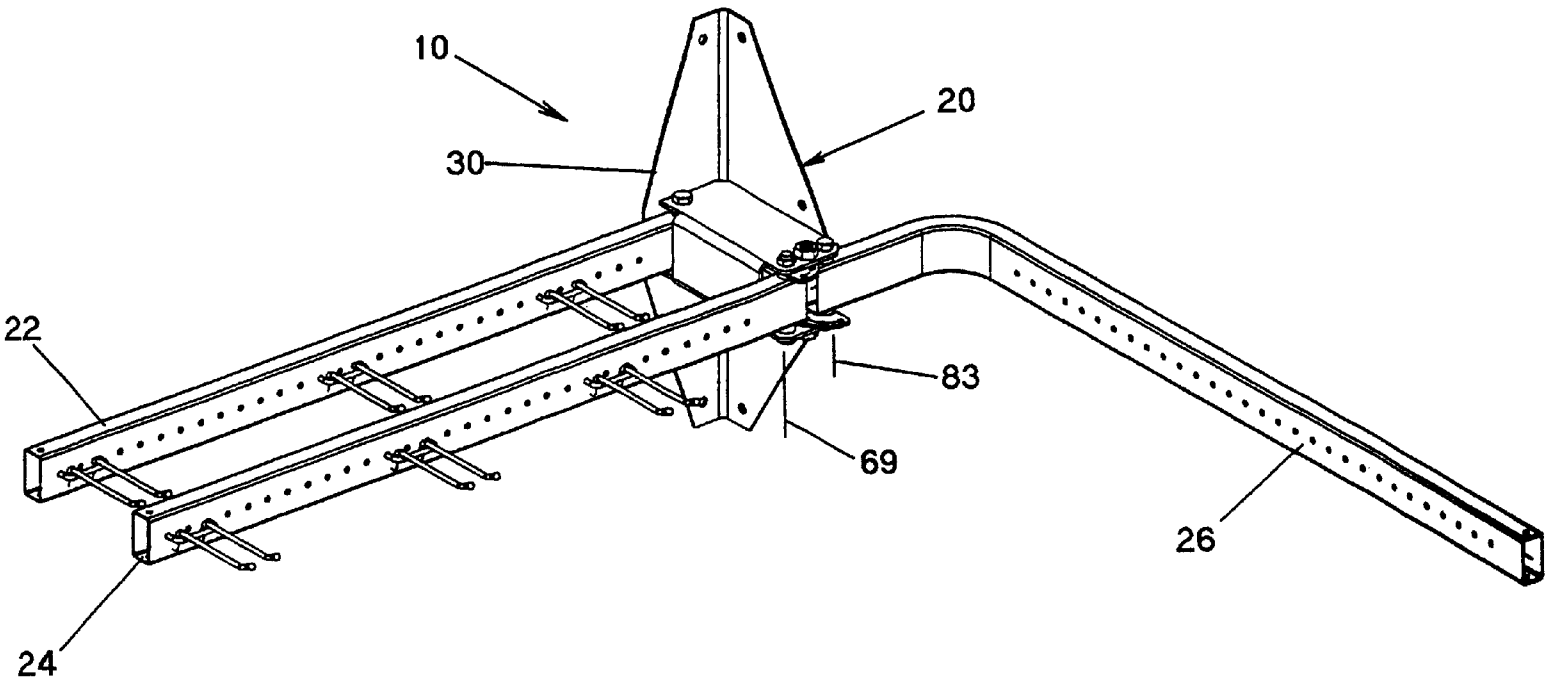
FIG. 3 is a front perspective view of the tool rack organizer of FIG. 1 with the support arms in the partially opened position.
Figure 4:
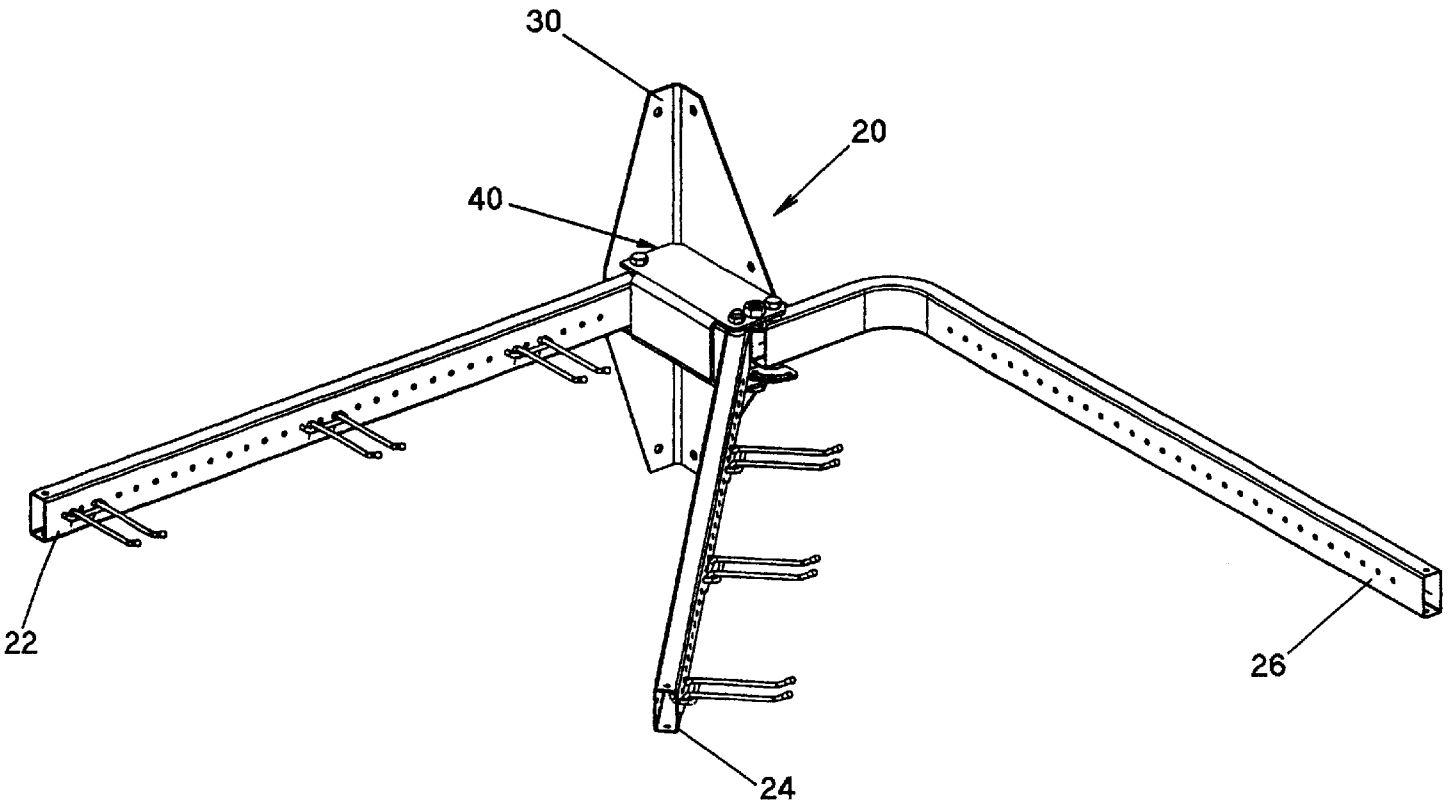
FIG. 4 is a front perspective view of the tool rack organizer of FIG. 1 with the support arms in the fully opened positions.

The organizer 10 includes a support bracket assembly 20 supporting an inner or rear arm 22, a middle arm 24 and an outer or front arm 26 aligned in horizontal rows parallel to the surface 12. As shown in FIGS. 1 and 2, the organizer has a closed storage position whereat the arms are in vertically aligned, uniformly horizontally transversely spaced relationship. As shown in FIG. 3, the outer arm 26 may be pivoted outwardly to a partially opened position to gain access to the middle arm 24. As shown in FIG. 4, thereafter the middle arm 24 may pivoted outwardly to a fully opened position to gain access to the articles on the inner arm 22.

The support bracket assembly 20 is attached to the support surface 12 and typically the studs therebehind by suitable threaded fasteners 28.

Figure 5:
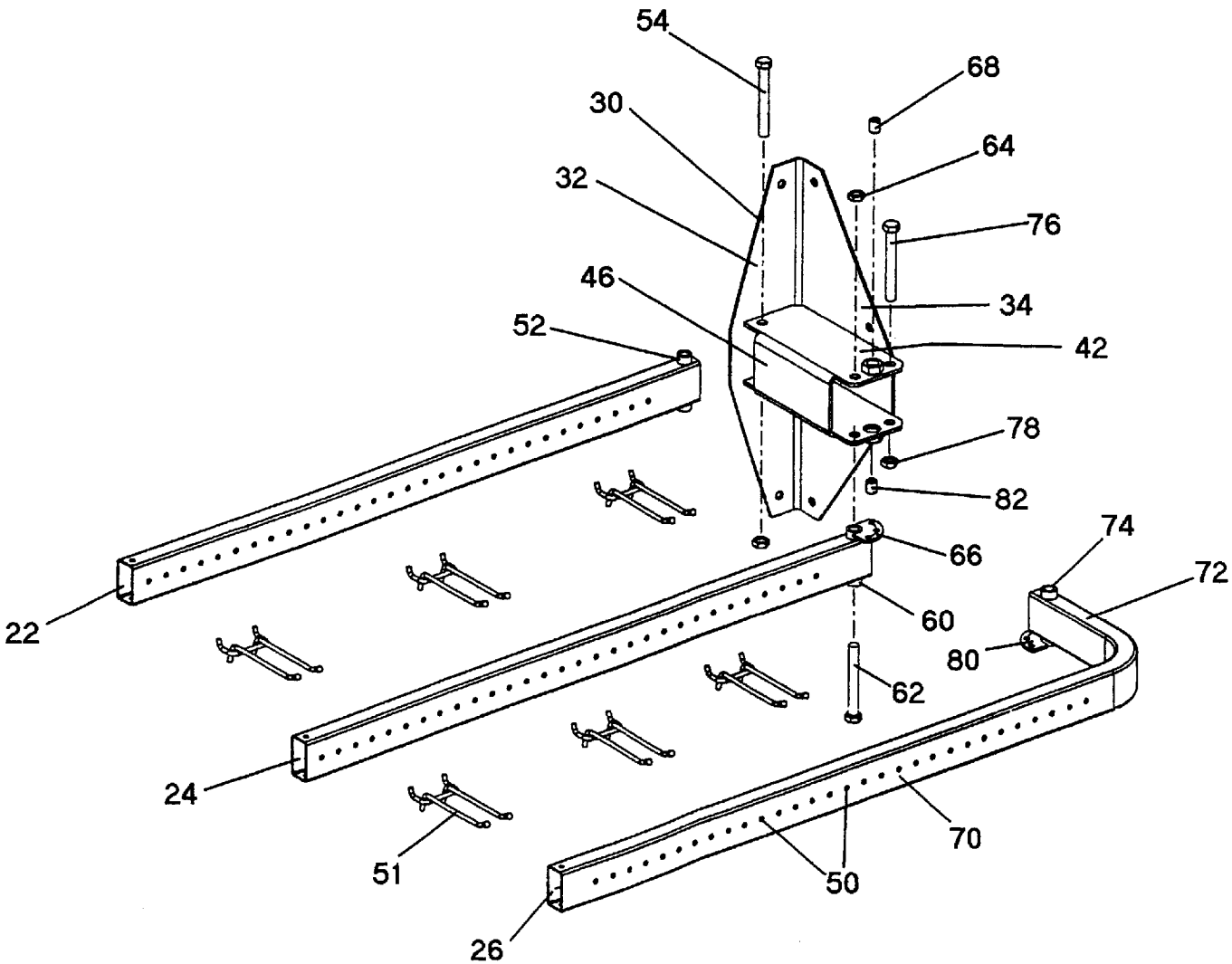
FIG. 5 is an exploded perspective view of the tool rack organizer of FIG. 1 illustrating the organizer components.

Referring additionally to FIG. 5, the support bracket assembly 20 includes a support plate 30 having a triangular base leg 32 fastened to the surface 12 and a triangular front leg 34 integrally connected and transversely disposed with respect thereto. Both legs are provided with mounting holes 36 for attachment to adjacent support surfaces with the fasteners 28. It will be appreciated that the support bracket assembly 20 may also be corner mounted or along a side wall using the front leg 34 as the mounting surface. Moreover, the organizer may be assembled and mounted as a mirror image of the orientation shown in FIG. 1.

A U-shaped mounting bracket 40 is centrally attached to the support plate 30 by suitable means such as weldments. The bracket 40 includes a rectangular horizontal top plate 42 interconnected with a rectangular bottom plate 44 by a rectangular vertical center plate 46. The inner side of the center plate 46 is forwardly spaced from the base leg 32 to establish therebetween a rectangular slot for receiving the inner end of the rear arm 22. The outer side of the center plate 46 is spaced inwardly from the outer sides of the plates 42 and 44 for receiving the inner ends of the middle arm 24 and outer arm 26.

The arms 22, 24 and 26 are formed of rectangular tubing and include a longitudinal series of hook mounting holes 50 on the front and rear walls for supporting conventional peg-board type mounting hooks 51.

The rear arm 22 is formed of a single length of tubing and includes vertically aligned cylindrical bushing 52 at the inner end having a sliding fit within the inner slot in the mounting bracket 40. A bolt 54 extends through apertures in the plates 42, 44 and bushings 52 and threaded to nut 56 to fixedly capture the inner end of the rear arm 22 fixedly locating the arm adjacent the surface 12.

The middle arm 24 is formed of a single length of tubing and includes vertically aligned cylindrical bushing 60 at the inner end having a sliding fit within the outer slot in the mounting bracket 30. A bolt 62 extends through apertures in the outer front edges of the plates 42, 44 and the bushing 60 and threaded to nut 64 to pivotally support the inner end of the middle arm 24. The upper end of the bushing 60 includes a detent sector 66 having a series of indents that cooperate with an upper detent ball assembly 68 threaded in a nut in the upper plate 42 to establish detented positions for the middle arm as shown in FIGS. 3 and 4. Accordingly, the middle arm is pivotal about a vertical axis 69 (FIG. 3 and located at the various detent positions The outer arm 26 is generally L-shaped having an outer portion 70 and an inner portion 72 transverse thereto, both formed of rectangular tubing. The outer portion 70 is comparable to the rear and middle arms including the aligned mounting holes 50. The inner portion 72 includes vertically aligned cylindrical bushing 74 at the inner end having a sliding fit within the outer slot in the mounting bracket 30. A bolt 76 extends through apertures in the outer front edges of the plates 42, 44, aligned with and outward of the apertures for the middle arm, and bushing 74 and threaded to nut 78 to pivotally support the inner end of the middle leg 24. The lower end of the bushing 74 includes a detent sector 80 having a series of indents that cooperate with an upper detent ball assembly 82 threaded into a nut on the lower plate 44 to establish detented positions for the outer arm as shown in FIGS. 3 and 4. The outer or front arm 26 is thus pivotable about a vertical axis 83 (FIG. 3) through the detented positions.

In use, the organizer may be mounted at a convenient location with the arms horizontally aligned. The organizer may be selectively assembled in either left hand or right hand orientations. The mounting hooks may be arrayed on the arms to receive associated articles for storage. The outer and middle arms may be selectively pivoted to separately and selectively present the arm carrying a desired article for storage or removal. After completion, the arms may be returned to the compact closed position.

Figure 6:
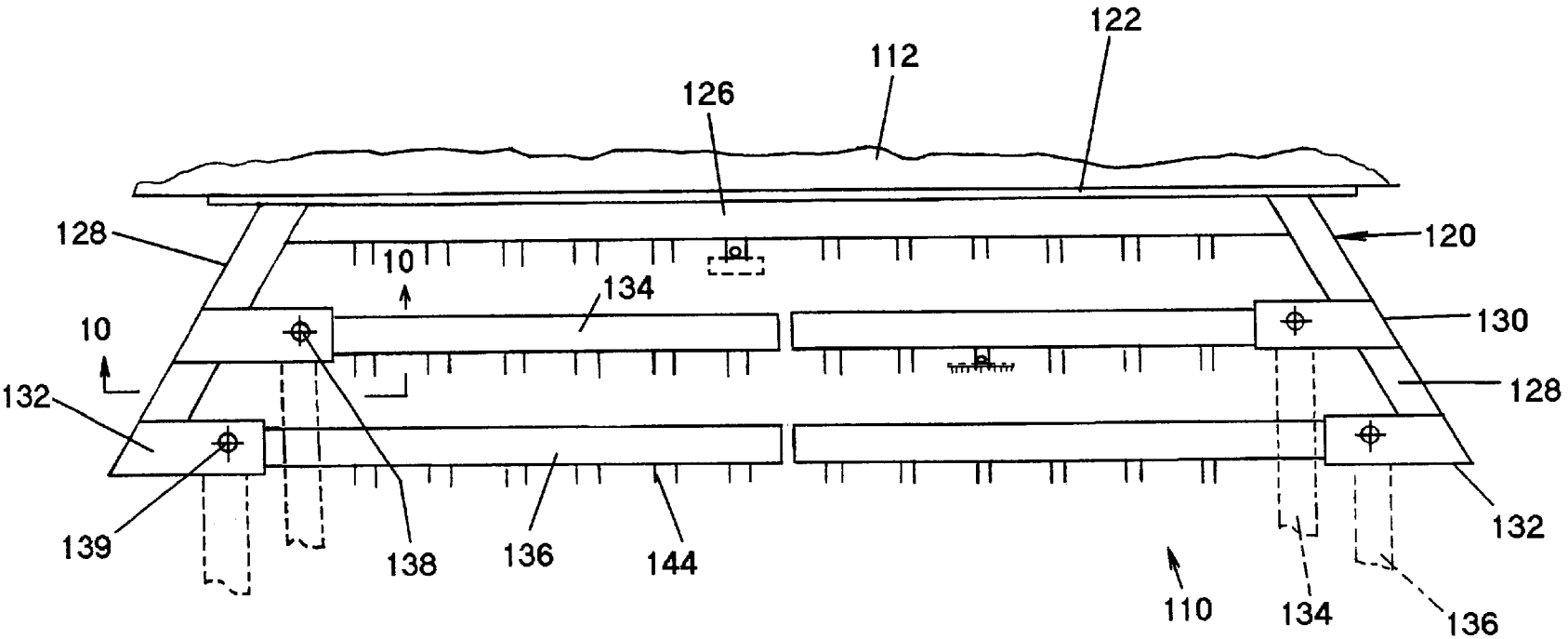
FIG. 6 is a top view of a tool rack organizer in accordance with another embodiment of the invention.
Figure 7:
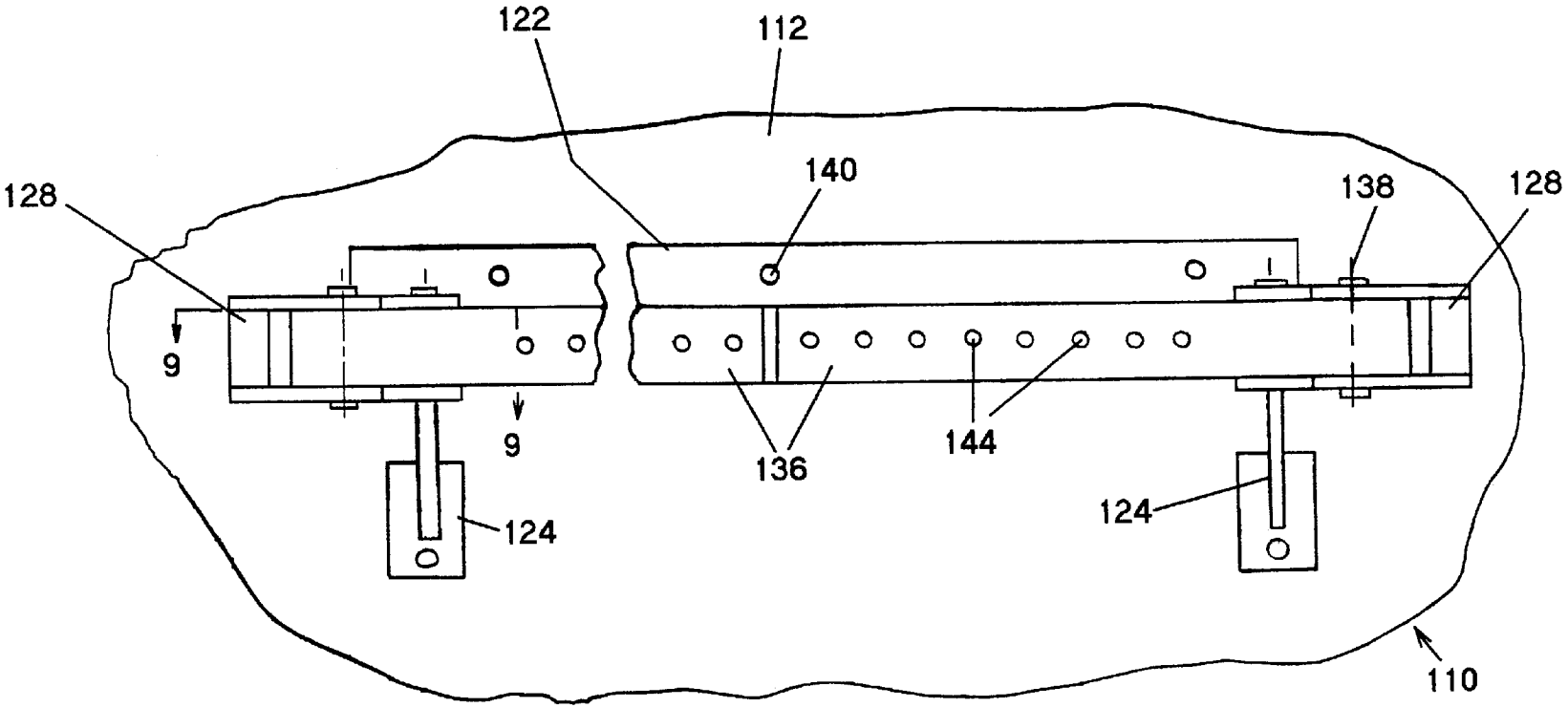
FIG. 7 is a front view of the tool rack organizer of FIG. 6.

A further embodiment of the invention is shown in FIGS. 6 through 12. Therein, FIG. 6 illustrates a tool rack organizer 110 mounted on a vertical surface 112, such as a garage storage wall, for the compact storage and easy accessibility of a variety of tools and implements of the type commonly used in the maintenance of a household and grounds. For example, the organizer 110 may hold various handled lawn tools, such as hoes and rakes, and home tools, such as hammers and hand tools. It will also be appreciated that the organizer may be beneficially used in connection with businesses and trades in a commercial setting for the storage of equipment used in such pursuits.

Figure 8:
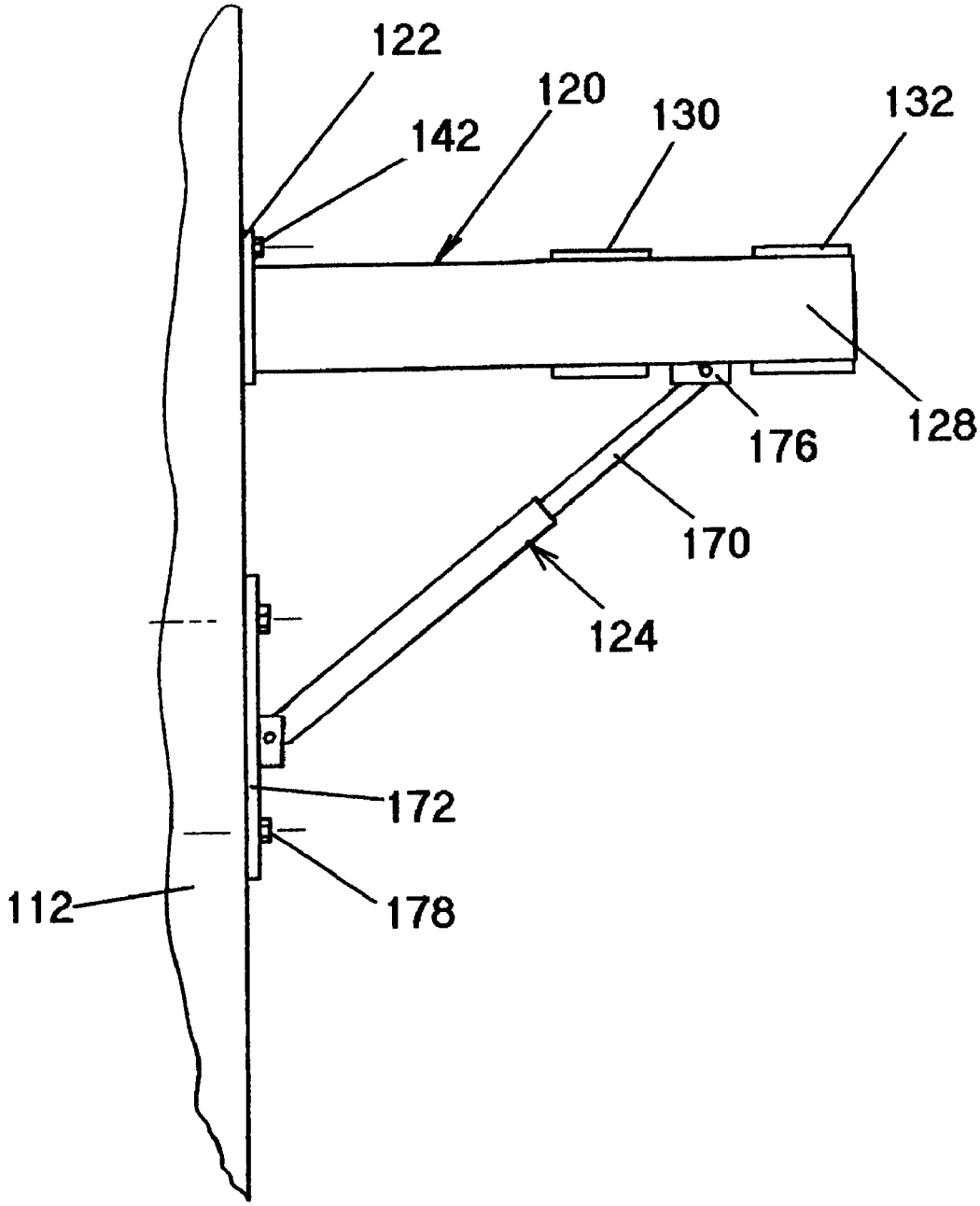
FIG. 8 is a side view of the tool rack organizer of FIG. 6.

More particularly, the organizer 110 comprises a rack assembly 120 attached to the wall 112 at a rectangular mounting plate 122 and vertically reinforced by triangulated leg assemblies 124 (FIG. 8). The rack assembly 120 includes a fixed inner support arm 126, a pair of pivotal middle support arms 134, and a pair of outer support arms 136. The arms 134 and 136 are pivotable between the closed position shown in solid lines and the open position shown by dashed lines. The inner arm 126 is an elongated rectangular tube that is attached by suitable means, such as welds, at a rear surface to the front surface of the mounting plate 122. The rack assembly 120 includes a pair of longitudinally spaced, frontally and outwardly diverging support brackets 128 attached at rear ends to the outer ends of the base arm 126.

Each support bracket 128 includes in spaced relation a middle support plate assembly 130 and an outer support plate assembly 132, respectively pivotally carrying in transversely aligned and parallel spaced relationship arms 134, 136. The arms 134, 136 are connected at inner ends to the support brackets 128 by vertical pin connections 138 and 139, respectively, with the pin connection 139 lying longitudinally and frontally outward of the pin connection 138. The rack arms 134, 136 are disposed in pivotal in non-overlapping, phase opposition for movement between the closed storage position shown in solid lines and the open handling position shown in dashed lines. The side brackets 128 are outwardly inclined with respect to the base arm 126 in the range of about 30° to 70°, to allow full non-interfering pivotal movement between storage and open positions. A divergence around 45° to 60° is preferred. For compactness, a spacing of about 4 to 12 inches is preferred.

The arms 126, 134 and 136, and the side brackets 128 are formed of rectangular galvanized steel tubing, or like construction components suitable for the application. The inner arm 126 is attached to the mounting plate 122 by welds 140. The ends of the inner arm 126 are beveled for attachment to the inner sidewalls of the side brackets 128. The mounting plate 122 is provided with a longitudinal series of apertures 140 for receiving conventional and suitable fasteners 142 for attaching the organizer 110 at a desired and convenient location on the vertical surface 112. The front vertical surface of the inner arm 126 is provided with a longitudinal series of attachment holes 144 for receiving conventional mounting hooks 146 for suspending the tools and equipment. Suitable hooks may be of the two-leg type used for pegboard applications, in which instance the hole spacing is appropriate for selective, variable location on the inner arm 126.

Figure 9:
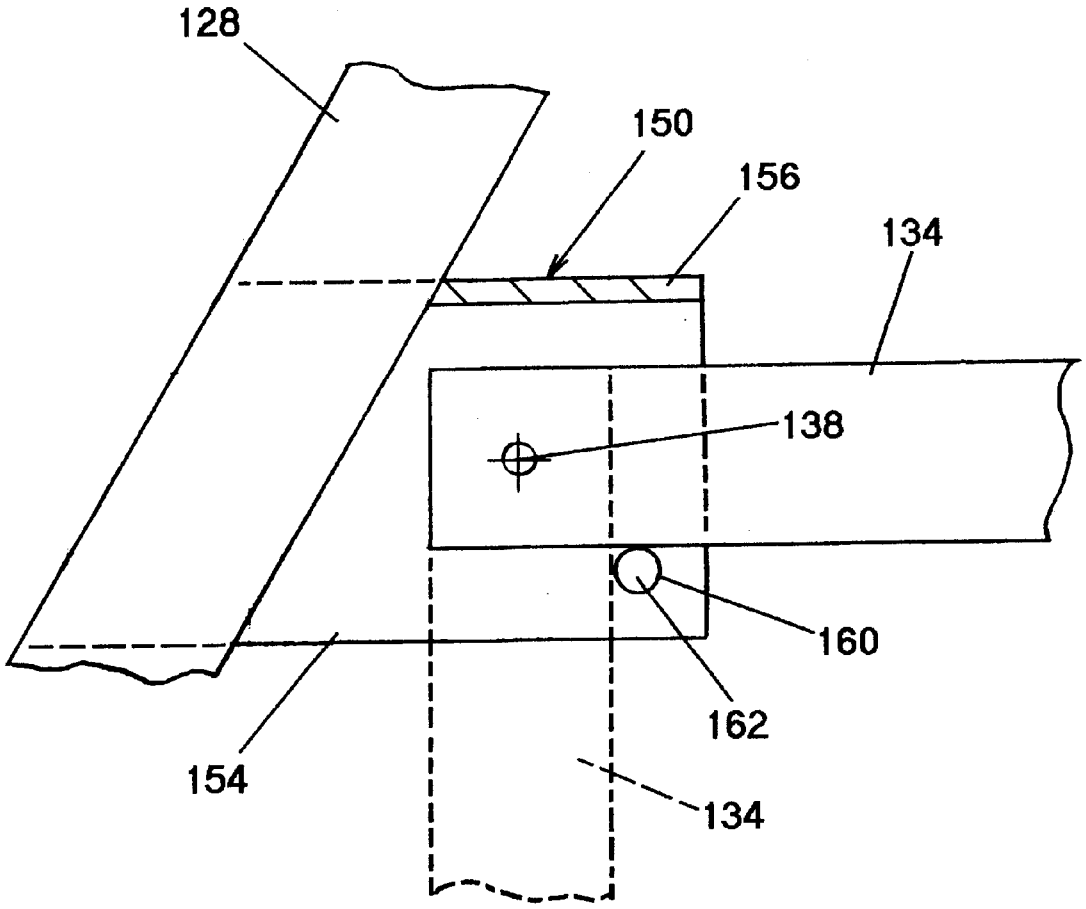
FIG. 9 is a cross sectional view taken along line 9—9 of FIG. 7 showing the support arm assembly and illustrating the open position of the support arm in dashed lines.
Figure 10:
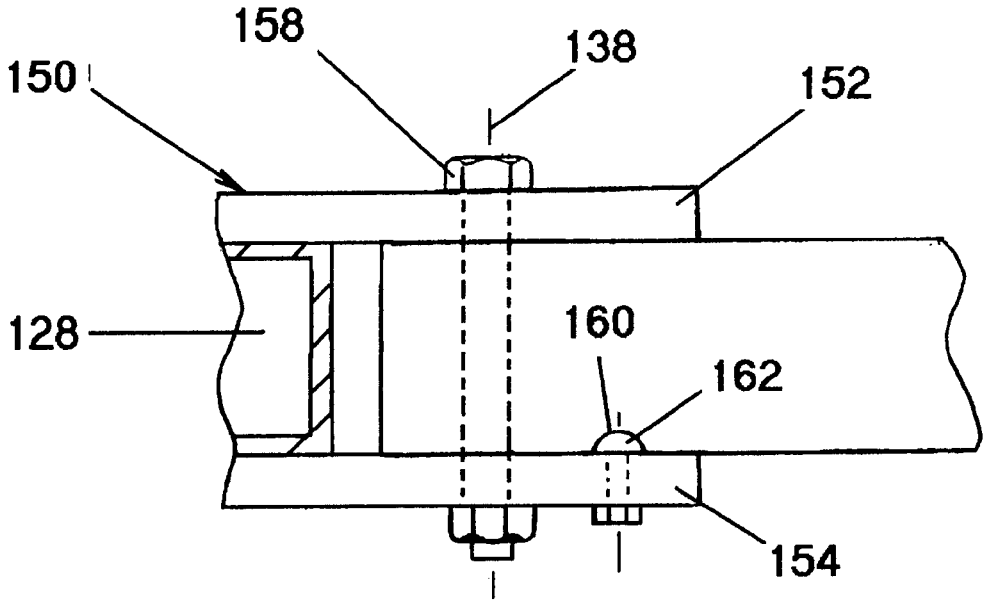
FIG. 10 is a cross sectional view taken along line 10—10 of FIG. 6 showing the support arm assembly.
Figure 11:
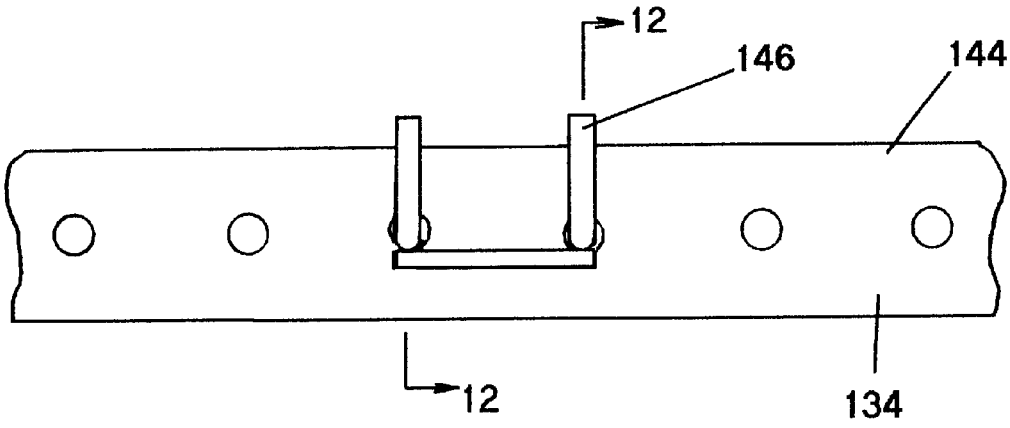
FIG. 11 is a fragmentary front view of the base leg illustrating the mounting hook.
Figure 12:
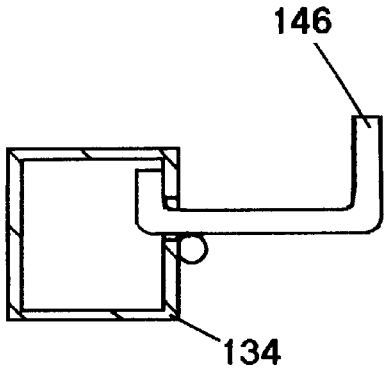
FIG. 12 is a cross sectional view taken along line 12—12 of FIG. 11.

Referring to FIGS. 9 and 10, the side brackets 130 include support arm holder 130, 132 for pivotally supporting the arms 136, 136. Each support arm holder includes an upper support plate assembly 150 including a a top plate 152 attached to the top surface of the side bracket 128 and a bottom plate 154 attached to the bottom surface of the side bracket 128. The top plate 152 and the bottom plate 154 are interconnected at the rear margins by a vertical rear sidewall 156. The plates 152, 154 and the sidewall 156 form inwardly and frontally opening pockets for slidably receiving the inner ends of the arms. The plates 152, 154 and the inner ends of the arms are provided with aligned vertical apertures for receiving the shanks of the pivotal connectors 138. A suitable connector is an appropriately sized threaded fastener 158 (FIG. 10). To maintain the arms in the desired storage or handling position, as shown in FIGS. 9 and 10, a detent 160 is provided in the bottom plate 154 having a detent head 162 at the top surface thereof. In the closed storage position, the detent head 162 engages the front wall of the arms to resist outer pivoting. In the open handling positions, the detent head 162 engages the rear wall the arms to maintain the extended position. As illustrated, a threaded fastener is a suitable mechanism. The position of the detents may vary to prescribe the desired angularity of the rack arms in the handling position.

The inner opposed ends of the arms 134, 136 are slightly spaced in the closed positions and may be covered with suitable end caps, if desired. The front walls of the arms are provided with a longitudinal series of holes for receiving the aforementioned mounting hooks.

Referring to FIG. 8, the leg assemblies 124 includes a support strut 170 connected at a lower end to a base plate 172 at bracket 174 and connected at an upper end to the front lower wall of the side bracket 128 at bracket 176. The base plate 172 is fixedly connected to the support surface 112 by threaded fasteners 178. The length of the strut 170 may be provided with axial adjustability, for horizontally orienting and structurally supporting the legs 128 in operative position.

In use, with the organizer attached at a desired location on the surface 112, the hooks 144 are attached at desired locations on the support arms for the convenient mounting of the user's equipment. Thereafter, the arms are folded to the closed storage position and disposed in parallel rows. When a desired item is required, the arms are opened as required to gain access and removal, and the opened arms returned to storage positions. The sequence is reversed for return storage of the items.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the sprit and scope of the present invention. The disclosures and description herein are intended to be illustrative and are not in any sense limiting of the invention, which is defined solely in accordance with the following claims.

What is claimed:

1. An apparatus for organizing and storing hand tools, comprising: an mounting member for horizontal attachment to a vertical surface; a first tool support member associated with said mounting member; first hook means connected with said first tool support member for supporting said hand tools; a horizontal side support member attached at either end of said mounting member and diverging forwardly and outwardly thereof at an acute angle; a second tool support member pivotally connected at an inner end to each of said side support members for movement between a storage position in frontally spaced relationship to said mounting member; second hook means connected with said second tool support members for supporting said hand tools, said second tool support members being pivotal from said storage position to a second position whereat said hand tools may be removed from said first and second hook means wherein said hook means are adjustably positions on said support members.

2. The apparatus as recited in claim 1 wherein said angle of diverging is around 30° to 70°.

3. The apparatus as recited in claim 2 wherein said angle is around 45° to 70°.

4. The apparatus as recited in claim 1 wherein said hook means are adjustably positioned at said holes.

5. The apparatus as recited in claim 1 wherein said support members of formed of rectangular tubing.

6. The apparatus as recited in claim 1 wherein detent means coact between said second tool support members and said side support members for establishing said storage position.

7. The apparatus as recited in claim 6 wherein said detent means coact to maintain said open position.

8. The apparatus as recited in claim 1 including legs support members extending downwardly from said side support members for attachment at lower ends to said vertical surface.

9. The apparatus as recited in claim 1 wherein said second tool support members are longitudinally aligned.

10. The apparatus as recited in claim 1 wherein said second tool support member have substantially equal length.

11. A tool organizer, comprising: a support assembly for horizontal attachment to a vertical surface, an elongated first support arm horizontally connected to said support assembly adjacent said vertical surface; an elongated second support arm horizontally connected at one end to said support assembly at a first pivotal connection for movement between a closed position in parallel spaced relation to said first support arm and an open position pivotally removed from said first support arm; an elongated third support arm horizontally connected at one end to said support assembly at a second pivotal connection movement between a closed position in parallel spaced relation to said first support arm and said second support arm and an open position pivotally removed from said first support arm and further including detent means cooperating between said support assembly and said second and third support arms for providing detented positioning between said closed position and said open position.

12. The tool organizer as recited in claim 13 wherein said second support arm is a unitary linear member having an inner end pivotally connected to said support assembly at a first axis in front of said first support arm.

13. The tool organizer as recited in claim 12 wherein said third support arm has an inner end pivotally connected to said support assembly at a second axis laterally beyond said first axis to allow non-interfering pivotal movement to said open position.

14. The tool organizer as recited in claim 13 wherein said second support arm is a unitary linear member and said third support arm is L-shaped having an outer portion parallel to said first and second support arms in the closed position and an inner portion having an inner end pivotally connected to said support assembly at said second axis.

15. The tool organizer as recited in claim 11 wherein said support arms include a plurality of laterally spaced openings in at least one side wall for facilitating the mounting thereat of peg-board type hooks.

16. An organizer for the storage of articles comprising: a support bracket having a planar base member and a planar side member normal thereto, said support bracket having a plurality of apertures for facilitating mounting on a vertical mounting surface; a bracket member attached to said base member and said side member of said support bracket and providing a first slot adjacent said base member opening laterally from said side member and a second slot spaced frontally thereof, said second slot providing a frontal and a lateral opening; an elongated first support arm having an inner end received in said first slot and an outer end extending parallel said base member for location along said mounting surface; an elongated second support arm having an inner end laterally received in said slot; a first pivot connection pivotally connecting said inner end of said second support arm and accommodating pivoting movement thereof between a closed position parallel said first support arm and an open position inclined with respect to said first support arm; an outer support member having an elongated third support arm and an inner arm transverse thereto, said inner end frontally received in said second slot between said side member and said first pivot connection; a second pivot connection pivotally connecting said inner arm of said outer support member and accommodating pivoting movement of said third support arm between a closed position parallel to said first and second support arms and an open position inclined with respect to said first support arms; a plurality of laterally extending openings in the side walls of said support arms; and hook means selectively attached to said support arms at said openings for supporting said articles therefrom.

* * * * *